US006340224B1

(12) United States Patent
Hotomi et al.

(10) Patent No.: US 6,340,224 B1
(45) Date of Patent: Jan. 22, 2002

(54) INK JET RECORDING HEAD

(75) Inventors: Hideo Hotomi, Nishinomiya; Kenji Masaki, Nagaokakyo; Koji Yamamoto, Takarazuka, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 08/855,943

(22) Filed: May 14, 1997

(30) Foreign Application Priority Data

May 14, 1996 (JP) ..... 8-118840

(51) Int. Cl.[7] ..... B41J 2/045
(52) U.S. Cl. ..... 347/70; 347/40
(58) Field of Search ..... 347/10, 11, 15, 347/40, 43, 70, 71, 68, 69

(56) References Cited

U.S. PATENT DOCUMENTS

| | | | | | |
|---|---|---|---|---|---|
| 4,635,078 | A | * | 1/1987 | Sakurada | 347/15 |
| 4,682,216 | A | * | 7/1987 | Sasaki et al. | 347/43 |
| 4,746,935 | A | * | 5/1988 | Allen | 347/15 X |
| 5,208,605 | A | | 5/1993 | Drake | 346/1.1 |
| 5,412,410 | A | | 5/1995 | Rezanka | 347/15 |
| 5,424,769 | A | * | 6/1995 | Sakai et al. | 347/70 |
| 5,453,767 | A | * | 9/1995 | Chang et al. | 347/10 |
| 5,581,286 | A | * | 12/1996 | Hayes | 347/15 X |
| 5,642,142 | A | * | 6/1997 | Bohorquez | 347/15 |
| 5,646,662 | A | * | 7/1997 | Kitahara | 347/70 |
| 5,818,481 | A | * | 10/1998 | Hotomi et al. | 347/68 |
| 5,898,448 | A | * | 4/1999 | Ishikawa | 347/69 |

FOREIGN PATENT DOCUMENTS

| | | | | |
|---|---|---|---|---|
| JP | 55-74883 | * | 6/1980 | B41J/3/04 |
| JP | 61-100469 | * | 5/1986 | |
| JP | 1-242259 | * | 9/1989 | B41J/3/04 |
| JP | 2-286251 | * | 11/1990 | B41J/2/205 |

* cited by examiner

*Primary Examiner*—Benjamin R. Fuller
*Assistant Examiner*—C Dickens
(74) *Attorney, Agent, or Firm*—Sidley Austin Brown & Wood

(57) ABSTRACT

An ink-jet recording head (1) comprises a first head portion (10) and a second head portion (20). The head portion has a plate (2) which includes an ink cavity (11,21) for receiving a ink material and a nozzle (14,24) fluidly communicated with ink cavity for ejecting the ink material. A piezoelectric actuator (15,25) which deforms to pressurize the ink material to eject the same through the nozzle when a voltage is applied to he piezoelectric actuator. In addition, both sizes of the ink cavity and associated piezoelectric actuator in the first head portion are different from those in the second head portion.

15 Claims, 7 Drawing Sheets

INK JET RECORDING HEAD

BACKGROUND OF THE INVENTION

The present invention relates to a Drop-On-Demand ink jet recording head for use in an ink-jet recording apparatus, and particularly to an ink jet recording head by which an ink material is ejected in response to an image signal and then deposited onto a recording medium such as plain paper to reproduce an image.

There have been proposed a variety of Drop-On-Demand ink-jet recording head. The recording head includes a pressurizing member, such as a heat member or piezoelectric member, which pressurizes an ink material in an ink cavity in response to an image signal so as to eject ink droplets through a nozzle into the air. The ejected ink droplets are deposited on a recording medium such as plain paper to form an image consisting of a number of dots.

One known method for reproducing a continuous tone image by the use of such ink-jet recording head, is to change the size of ink droplets ejected through the nozzle so as to change the size of dots deposited on the recording medium. For this purpose, there has been proposed an ink-jet recording head which includes large nozzles for ejecting large ink droplets and small nozzles for ejecting small ink droplets. Specifically, U.S. Pat. No. 5,208,605 discloses a printer head in which a large-nozzle array and a small-nozzle array are arranged in parallel. Also, Japanese Patent Laid-Open Patent Publication 6-238092 discloses an ink jet printer head in which large nozzles and small nozzles are arranged alternately in a row.

Technically, however, it is difficult to form a multiplicity of large and small nozzles of different sizes in one head with a great precision such as on the order of a micron. Further, there is a limitation in the adjustable range of nozzle diameter, for example, due to the fact that reducing the nozzle diameter too much would make it more likely that clogging takes place in the small nozzle. As a result, it would be difficult to realize sufficiently wide, smooth gradation by varying the dot diameter only with different nozzle diameters.

SUMMARY OF THE INVENTION

Among the several objects and features of the invention may be noted the provision of an ink-jet recording head for use in an ink-jet recording apparatus, and the provision of an ink-jet recording head capable of ejecting ink droplets of different sizes.

An ink-jet recording head of the invention comprises first and second head portions. Each head portion has a member which includes an ink cavity for receiving a ink material and a nozzle fluidly communicated with the ink cavity for ejecting the ink material. The head portion has a piezoelectric actuator. The actuator deforms to pressurize the ink material to eject the same through the nozzle into the air, when a voltage is applied thereto. The ink-jet recording head is characterized in that the sizes of both of the ink cavity and the associated piezoelectric actuator in the first head portion are different from those in the second head portion.

According to the ink jet recording head of the invention, since the ink cavity and piezoelectric actuator in the first head portion have different sizes from those in the second head portion, the pressure that acts on the ink material in the first head portion is different from that in the second head portion even when the same voltage is applied to piezoelectric actuators in the first and second head portions. Responsive to the difference in the pressure, the size of ejected ink droplet and the size of deposited ink dot by the first head portion will be different from those by the second head portion. Thus, according to the invention, a wider, smooth tone gradation can be realized.

The nozzle in the first head portion may be the same size as that of the second head portion. In this case, the nozzle is unlikely to suffer clogging, and it can be formed with a great precision.

Preferably, the ink-jet head comprises a controller which controls the voltage to be applied to piezoelectric actuator for changing the size of ink droplet to be ejected through the nozzle of the head portions. With this ink-jet recording head, an energy for pressurizing the ink material in the ink cavity by piezoelectric actuator will be changed depending upon the voltage to be applied to piezoelectric actuator, thereby changing the size of ink droplet to be ejected from the nozzle of each head portion and then the size of resultant ink dot on the recording medium in many steps. This results in a wider, smooth and continuous tone gradation.

Additionally, even when the voltage applied to piezoelectric actuators in the first and second head portions are changed in the same manner, since the sizes of the ink cavity and piezoelectric actuator in the first head portion are different from those in the second head portion, the sizes of the ink droplets ejected by the first head portion change in a range different from that by the second head portion. Therefore, the ink-jet recording head can be designed so that the first head portion ejects relatively small ink droplets while the second head ejects relatively large ink droplets and thereby causes the size of ink droplets to vary widely without increasing the load on the drivers of the head portions. Further, this allows the drivers to be simplified in construction and lowered in price.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

With reference to the drawings, preferred embodiments of the present invention will be described hereinafter.

Figure 1:
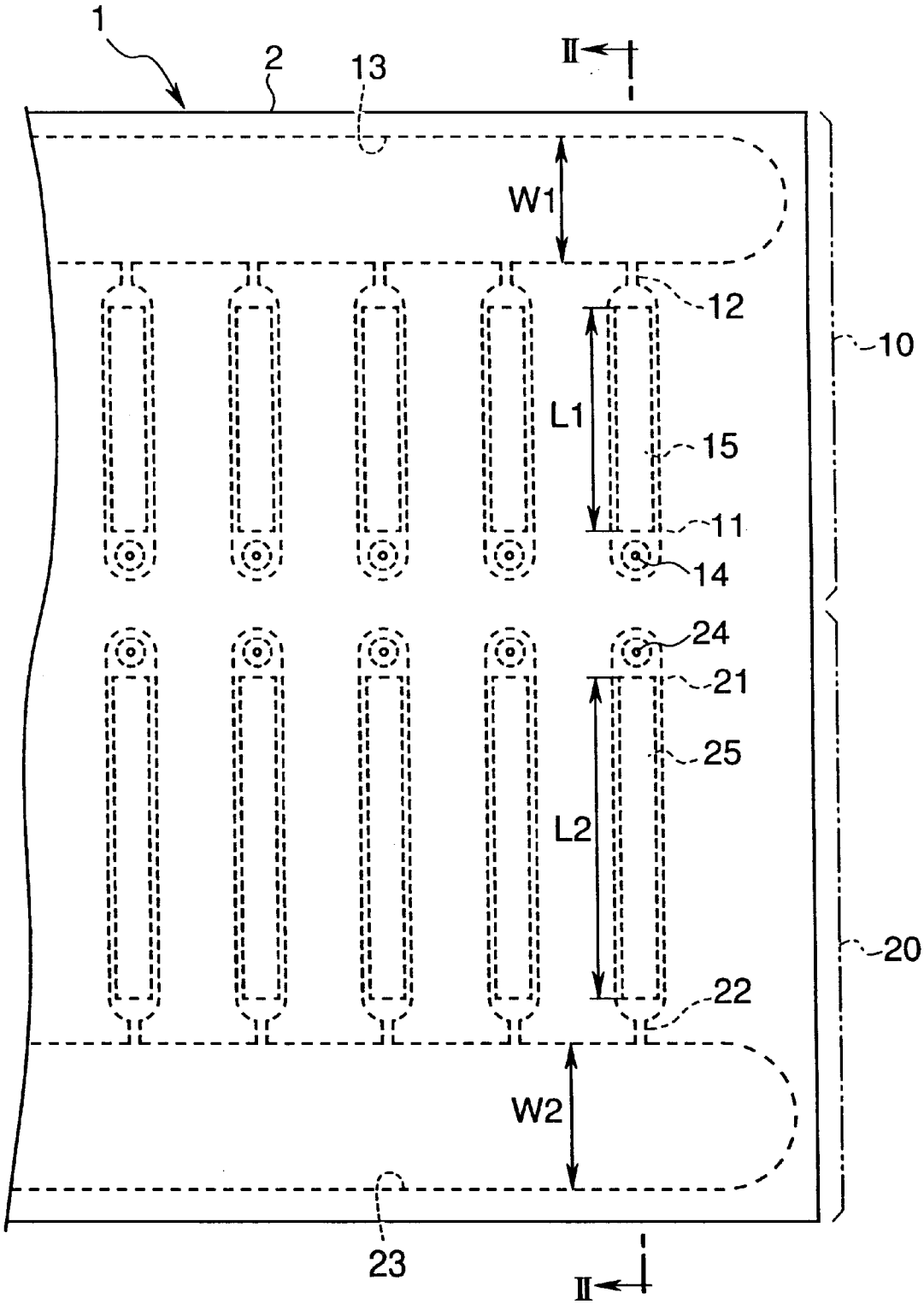
FIG. 1 is an enlarged plan view of an ink jet recording head according to a preferred embodiment of the present invention.
Figure 2:
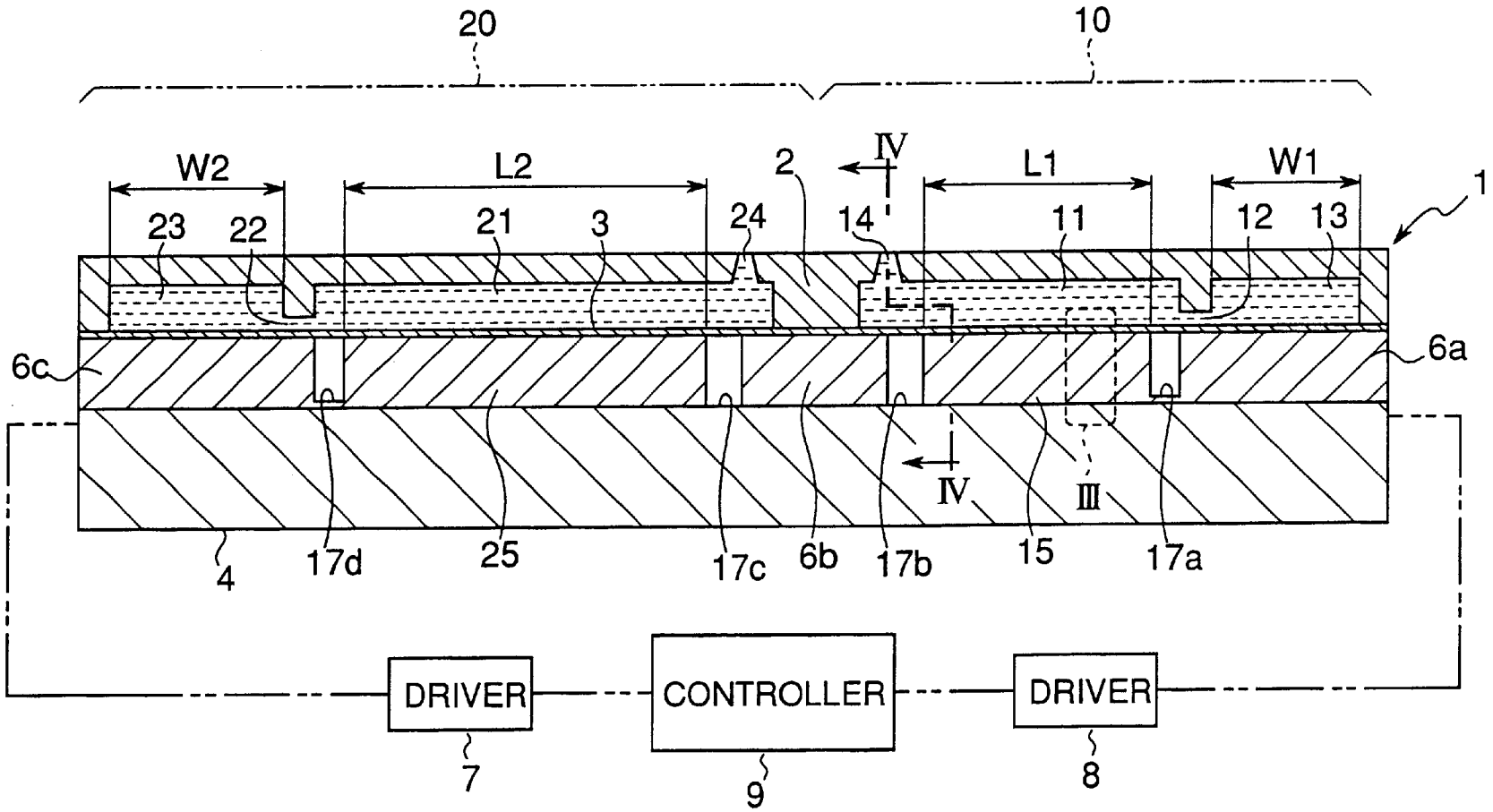
FIG. 2 is an enlarged cross sectional side elevational view of the ink-jet recording head taken along the line II—II in FIG. 1.

FIGS. 1 and 2 show an ink jet recording head generally indicated by reference numeral 1. The head 1 has first and second head portions generally indicated by reference numerals 10 and 20, respectively. The first and second head portions 10, 20 integrally comprise a cover plate 2, a diaphragm 3 and a base plate 4.

The cover plate 2, which is a planar plate made of metal or resin, has a first surface (i.e., upper surface in FIG. 2) away from the diaphragm 3 and a second surface (i.e., lower surface in FIG. 2) adjacent the diaphragm 3. The second surface of the cover plate 2 includes a plurality of concave portions, preferably formed by etching, lithography, or photolithography. The diaphragm 3, which is a thin plate made of metal or resin, is bonded on the second surface of cover plate 2 so as to close the concave portions, forming a plurality of elongated ink cavities 11 and 21, ink inlets 12 and 22, and ink supply chambers 13 and 23, for the first and second head portions 10 and 20, respectively. Preferably, the base plate 4 is made from a rigid member, such as, ceramic plate.

In the first head portion 10, each of the ink cavities 11 are arranged parallel to each other and fluidly communicate with the ink supply chamber 13 through associated ink inlet 12 so that an ink material provided in the ink supply chamber 13 can be supplied to the ink cavity 11. The cover plate 2 also has a plurality of nozzles 14 fluidly communicating the ink cavities 11 with the atmosphere for ejecting the ink material in the ink cavities 11 through respective nozzles 14. The nozzle 14 is arranged adjacent one end of the ink cavity 11 away from the ink inlet 12, along an imaginary line (not shown) extending perpendicular to a longitudinal axis of the ink cavity 11. Preferably, the nozzle 14 is in the form of truncated cone so that an inner diameter thereof decreases successively from the second surface towards the first surface, i.e., upper surface in FIG. 2.

The first head potion 10 further includes a plurality of elongated piezoelectric actuators 15, preferably made of piezoelectric materials, such as, lead zirconate and lead titanate. Piezoelectric actuator 15 is arranged along the ink cavity 11 and fixed between the diaphragm 3 and the base plate 4 by a known bonding technique. Preferably, piezoelectric actuator 15 has rectangular cross sections with respect to both longitudinal and transverse directions. Piezoelectric actuator 15 is capable of deforming when an electric voltage is applied thereto, thereby pressurizing the ink material in the adjacent ink cavity 11 to eject an ink droplet through the associated nozzle 14. For this reason, preferably, piezoelectric actuator 15 is configured that it has a length and a width slightly smaller than those of the ink cavity 11.

Like first head portion 10, in the second head portion 20, each of the plurality of ink cavities 21 are formed parallel to each other and fluidly communicate with the ink supply chamber 23 through associated ink inlet 22, allowing the ink material in the ink supply chamber 23 to be supplied into the ink cavity 21. The ink cavity 21 fluidly communicate with the atmosphere through the truncated-cone-like nozzles 24. Also, a plurality of elongated rectangular piezoelectric actuators 25 are mounted between the diaphragm 3 and the base plate 4 along the ink cavities 21.

As best shown in FIG. 1, the ink cavity 11 in the first head portion 10 and the adjacent ink cavity 21 in the second head portion 20 are arranged on a line. Also, the nozzles 14 and 24 have the same size. Advantageously and preferably, the nozzles 14 and 24 have the same diameter of about 25 microns at their outlet portions to prevent them from being clogged. Also, this permits them to be formed with great precision and ease, increasing the yield thereof, and thereby reducing the production cost of the ink-jet recording head.

Besides, the head portions 10 and 20 are designed so that the ink cavity 11 and piezoelectric actuator 15 in the first head portion 10 have different sizes from corresponding portions 21 and 25 in the second head portion 20. More specifically, the ink cavities 11 and 12 and piezoelectric-actuators 15 and 25 are of equal width, but a length $L_2$ of the piezoelectric actuator 25 is longer than a length $L_1$ of the piezoelectric actuator 15 and the ink cavity 21 is longer than the ink cavity 11. Hereinafter, the lengths of the ink cavities 11 and 12 corresponding to piezoelectric actuators 15 and 25 will be referred to as effective lengths $L_1$ and $L_2$ of ink cavities, respectively.

As described, the ink cavity 21 in the second head portion 20 is longer than the ink cavity 11 in the first head portion 10 and therefore the second head portion 20 accommodates a greater amount of ink material than the first head portion 10. For this reason, with respect to a direction parallel to the longitudinal axis of the ink cavity, the width $W_2$ of the ink chamber 23 of the second head portion 20 is designed to be greater than the width $W_1$ of the ink chamber 13 of the first head portion 10.

Although the nozzles 14 and 24 in the first and second head portions 10 and 20 have the same size in this embodiment, they may have different sizes. Besides, the nozzle may have different transverse cross section, for example, elliptical or rectangular cross section. Further, by varying the nozzle diameter, the upper and lower limits of the size of ink droplets ejected can be further enlarged.

Figure 3:
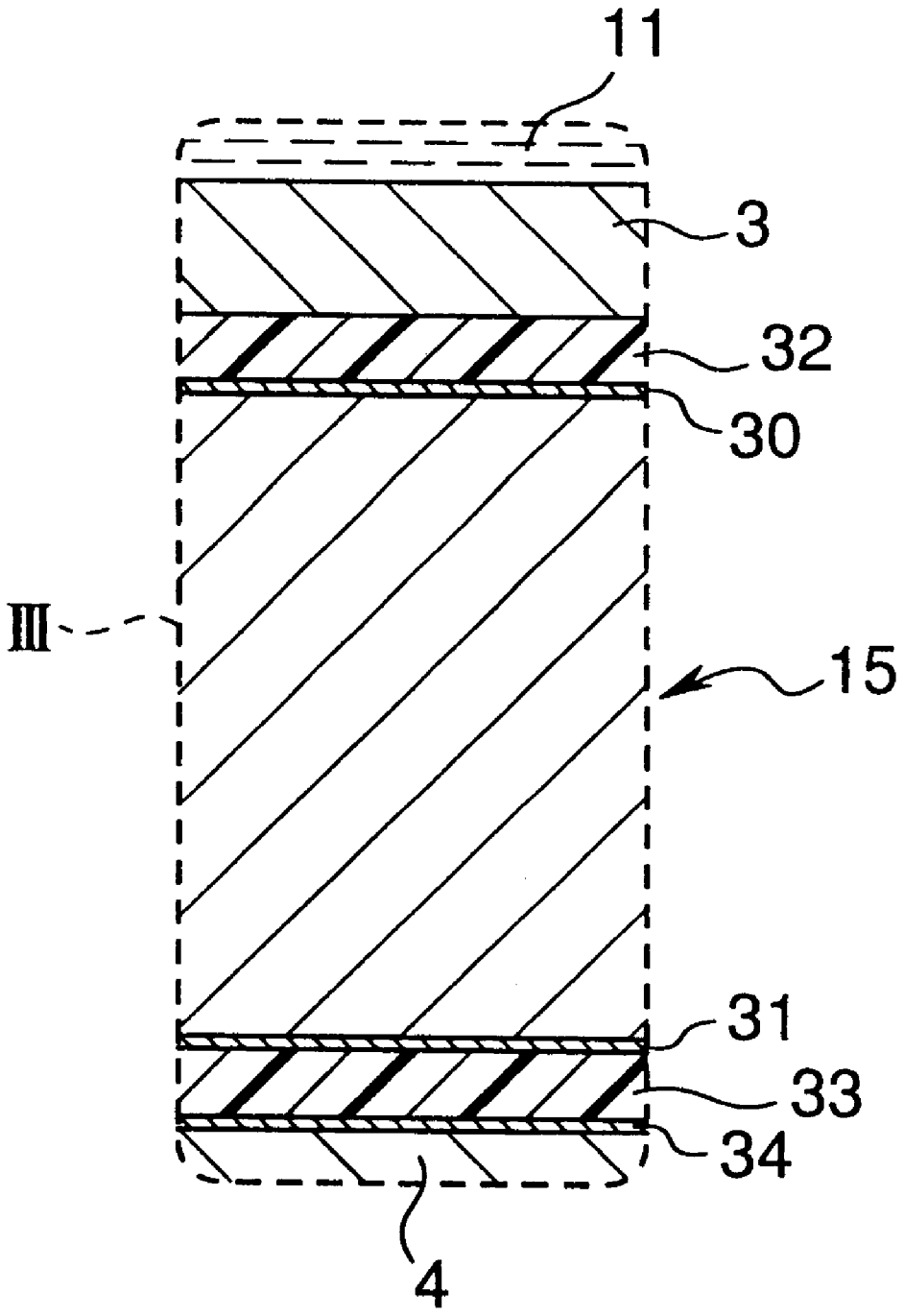
FIG. 3 is a partial enlarged side elevation view of the ink-jet recording head indicated at III in FIG. 2.

Referring to FIG. 3, piezoelectric actuators 15 and 25 have first and second metal electrodes 30 and 31 on opposite surfaces confronting diagram 3 and base plate 4, respectively. The electrode 30 is electrically communicated to ground through an electrically conductive adhesive layer 32 and diaphragm 3. The electrode 31, on the other hand, is electrically communicated through an electrically conductive adhesive layer 33 to a lead wire 34 patterned in correspondence thereto on a base plate 4. The electrical connection of the electrodes is not limited thereto, it may be modified in different ways.

Figure 4:
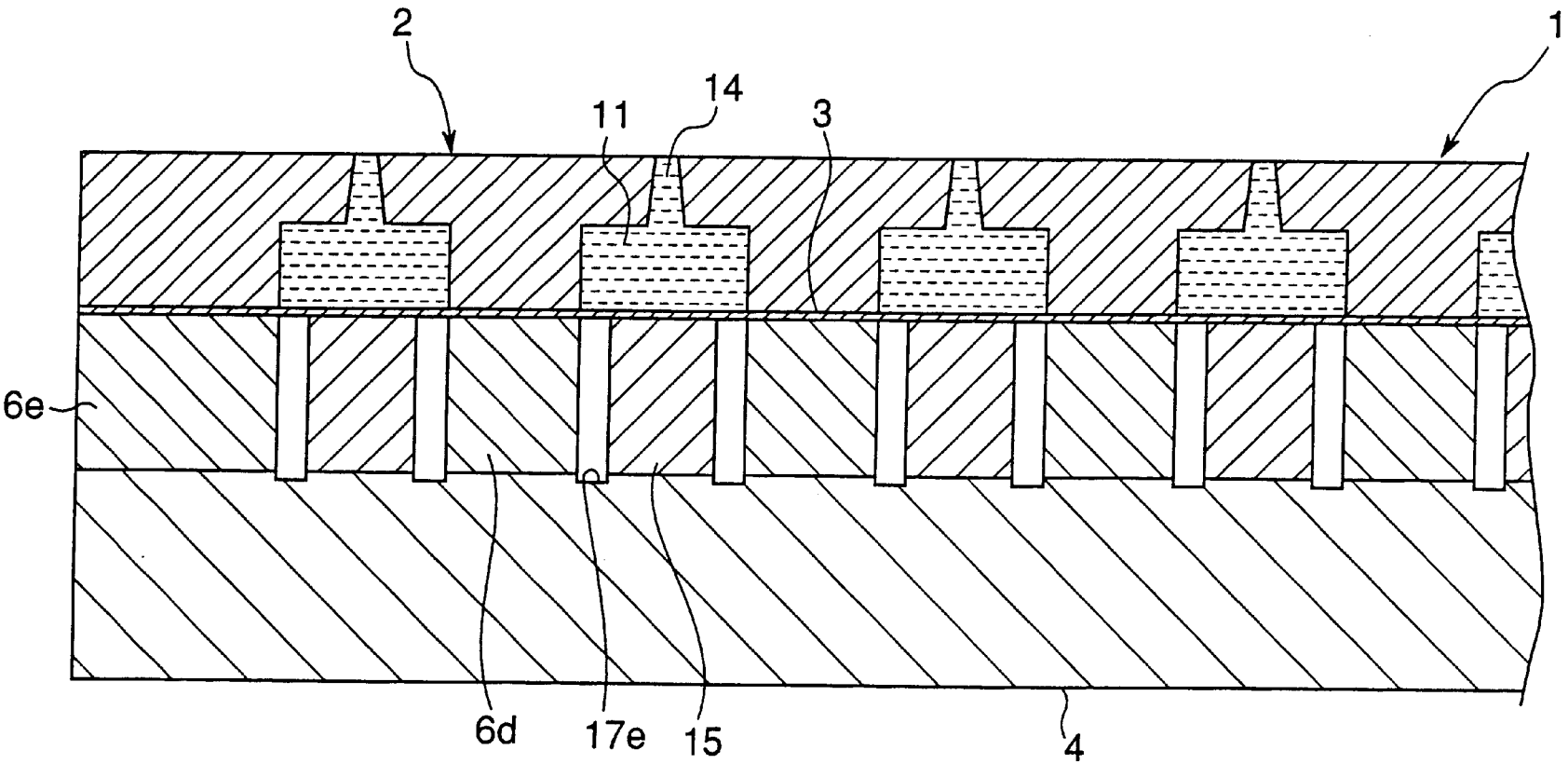
FIG. 4 is a cross sectional side elevation view of the ink-jet recording head taken along the line IV—IV in FIG. 2.
Figure 5:
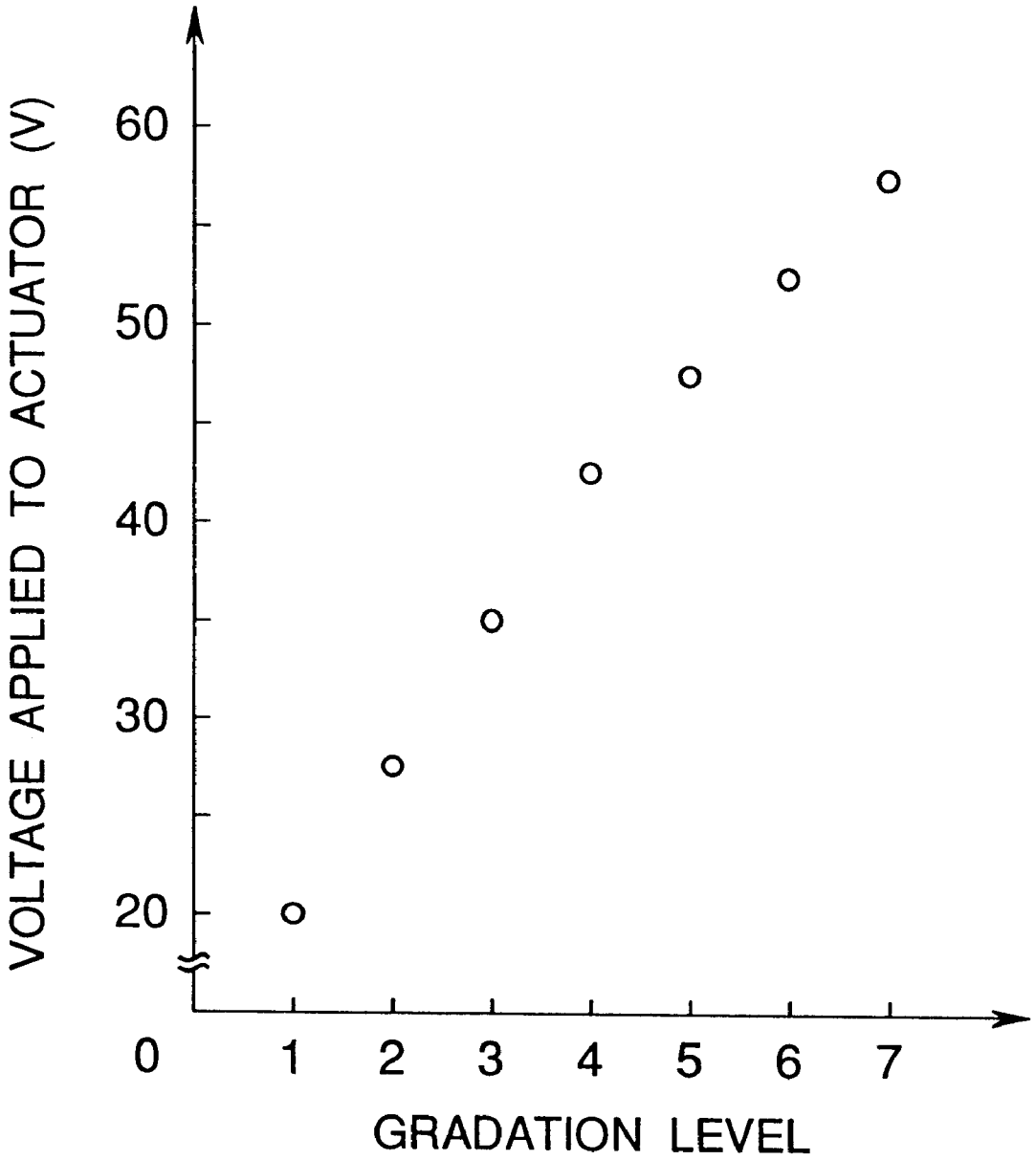
FIG. 5 is a graph showing a concrete example of the relationship between gradation levels and the voltage applied to piezoelectric actuators.

Piezoelectric actuators 15, 25 are formed prior to their bonding to the diaphragm 3 as described hereinafter. First, on the base plate 4 with the lead wires 34 formed thereon, one sheet of piezoelectric plate, having the electrode layers 30 and 31 deposited on its upper and lower surfaces by sputtering or plating or the like, is bonded with the conductive adhesive 33. Then, grooves 17*a* to 17*d* are formed as shown in FIG. 2 by a dicing saw (not shown). Particularly, the elongated grooves 17*b* and 17*c* are extended up to the base plate 4 by scraping off the corresponding portions of piezoelectric plate and adhesive layer 33. The grooves 17*a* and 17*d* are extended in piezoelectric plate so that small portions of piezoelectric plate still remain over the lead wires 34 to prevent the leads 34 from being cut off. Subsequently, portions of piezoelectric plate which will later be formed into piezoelectric actuators 15 and 25 are polarized by applying a high voltage between the electrodes 30 and 31 through the lead wires 34. Thereafter, as shown in FIG. 4, a plurality of elongated grooves 17*e* are formed in piezoelectric plate in the direction perpendicular to the recesses 17*a* to 17*d*, by which piezoelectric actuators 15 and 25 are formed individually. Preferably, as shown in FIG.4, grooves 17*e* are slightly extended into the base plate 4. This prevents each piezoelectric actuator 15 from being electrically connected with the neighboring actuator through the adhesive layer 33.

By the above groove cutting of the piezoelectric plate, spacing blocks 6*a* to 6*e* are formed around piezoelectric actuators 15 and 25 at the same time. The spacing blocks 6*a* to 6*e* have the same height as piezoelectric actuators 15 and 25 and therefore mechanically connect between the base plate 4 and diaphragm 3. Unlike piezoelectric actuators 15 and 25, the spacing blocks 6*a* to 6*c* are not polarized so that an application of the voltage to the electrodes 30 and 31 and the resultant electric field created in piezoelectric actuators 15 and 25 will never cause the spacing block to deform. Also, although the spacing blocks 6*d* and 6*e* are polarized, the lead wire 34 is not extended thereon and therefore no voltage is applied thereto, allowing the spacing blocks 6*d* and 6*e* to remain still.

Referring still to in FIG. 2, the lead wires 34 electrically connected to the corresponding piezoelectric actuators 15, 25 are extended out to opposite side surfaces of the base plate 4 so as to be electrically connected to a controller 9 via drivers 7, 8, respectively. The controller 9 is capable of varying the voltages to be applied to piezoelectric actuators 15 and 25 so that the size or diameter of the ink droplets to be ejected from the nozzles 14 and 24 of the heads 10 and 20 can be varied, respectively. For this purpose, the controller 9 is adapted to feed control signals to the respective drivers 7 and 8 in response to an image density signal supplied thereto. In accordance with the control signal, the drivers 7 and 8 are capable of changing the voltage or the shape of the signal, or pulse, to be applied to piezoelectric actuators 15 and 25, respectively. This results in the amount and speed of respective deformations of piezoelectric actuators 15 and 25, changing a pressurizing energy of the ink material in the ink cavities 11 and 21. As a result, the size of ink droplets to be ejected from respective nozzles 14 and 24, and the resultant ink dots formed by the deposition of the ink droplets on the recording sheet can be changed.

Operation for ejecting the ink material of the ink-jet recording head will be described hereinafter. The ink material is supplied to the ink chamber 13 and 23 of the first and second head portions 10 and 20. The ink material is then supplied to the ink cavities 13 and 23 from ink chambers 13 and 23, respectively. A pulse is applied from the drivers 7 and 8 to the piezoelectric actuators 15 and 25, respectively, in response to a control signal from the controller 9. The voltage of the pulse is determined depending upon an image density signal from the controller 9. When the voltage is applied to the piezoelectric actuator, it expands and deforms instantaneously in the direction of its thickness. This deformation in turn causes the diaphragm 3 to be pushed up, by which the ink material in the ink cavities 11 and 21 is pressurized. As a result, ink droplets, whose sizes are being controlled, are ejected through the nozzles 14 and 24. Then, the ink droplets deposit on the recording medium so that ink dots of different sizes are formed, thereby a halftone image may be recorded by the multiplicity of ink dots.

Figure 6:
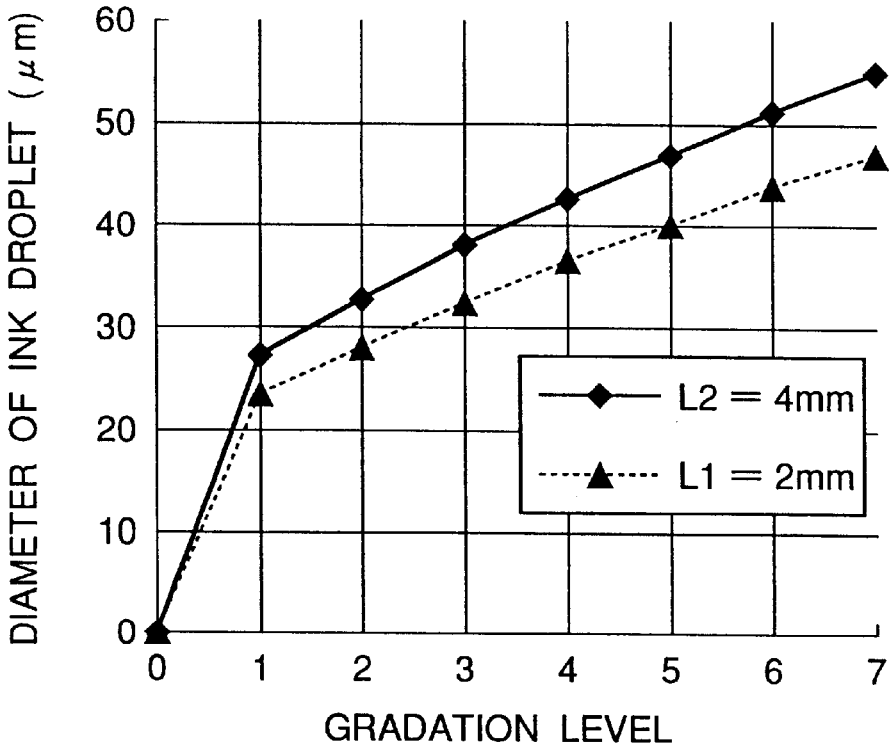
FIG. 6 is a graph showing the relationship between the gradation levels and the diameter of ink droplets from a first head portion having a short ink cavity (effective length $L_1$ is 2 mm) and a second head portion having a long ink cavity (effective length $L_2$ is 4 mm)

Using the ink-jet recording head 1, ink ejection tests were conducted to measure the size of ink dots on the recording sheet, or the size of ink droplets. The voltage of a rectangular pulse applied to the piezoelectric actuators 15 and 25 was varied by the controller 9 in eight steps of gradation level, 0 to 7. The effective lengths $L_1$ and $L_2$ were 2 mm and 4 mm, respectively, the outer most diameter of nozzle 14 and 24 was 25 $\mu$m, and the taper angle of the nozzles 14 and 24 was 15°. The result are shown in FIG. 6 in which the size of the ink droplets ejected from the head portions 10 and 20, or the resultant ink dots on the recording medium, increases generally linearly according to the gradation levels, from level 1 to level 7, and the diameter of ink droplets ejected from the second head portion 20, having longer effective length $L_2$, were larger than the diameter of ink droplets ejected from the first head portion 10 having shorter effective length $L_1$.

Figure 7:
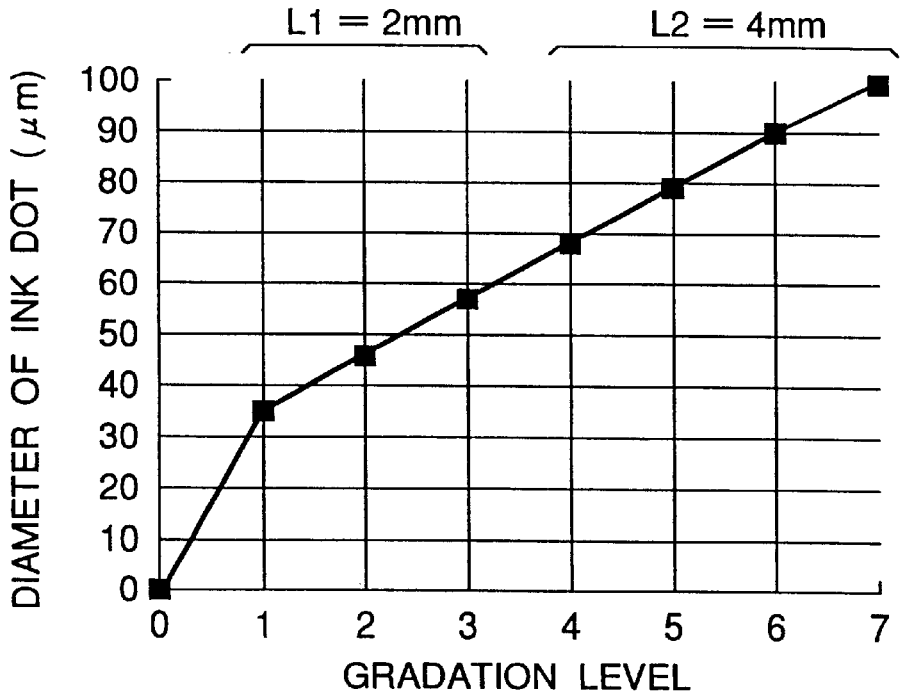
FIG. 7 is a graph showing the relationship between the gradation levels and the diameter of dots deposited on the recording medium by the first head portion ($L_1$=2 mm) and the second head portion ($L_2$=4 mm)

FIG. 7 shows the diameter of dots deposited on the recording medium together with the gradation levels. Ink dots of smaller diameter for the gradation level of 1 to 3 were formed by the first head portion 10, while ink dots of larger diameter for the gradation levels of 4 to 7 were formed by the second head portion 20. From FIG. 7, it can be seen that the diameter of deposited ink dots can be varied linearly in 7 steps. Note that the deposited dots for the gradation level of 1 to 3 were formed with ink droplets corresponding to the gradation levels of 1 to 3 with $L_1$=2 mm in FIG. 6, and the deposited dots for the gradation levels of 4 to 7 were formed with ink droplets corresponding to the gradation level numbers of 3 to 6 with $L_2$=4 mm in FIG. 6. With an arrangement that multi-level control of the diameter of deposited ink dots is performed by the head portions 10 and 20, the load imposed on respective drivers 7 and 8 of the head portions 10, 20, respectively, is reduced, which simplifies the construction of the drivers and reduces cost of the drivers.

As can be seen from the results, in the ink jet recording head 1 having the first and second head portions 10 and 20 whose effective lengths $L_1$, $L_2$ of ink cavities are different from each other, the dot diameter on the recording medium can be varied in many steps by controlling the voltage applied to actuators 15 and 25 of the respective head portions. Therefore, by an appropriate combination of ink dots having different diameters, a smooth, wider, and continuous tone gradation can be achieved.

Figure 8:
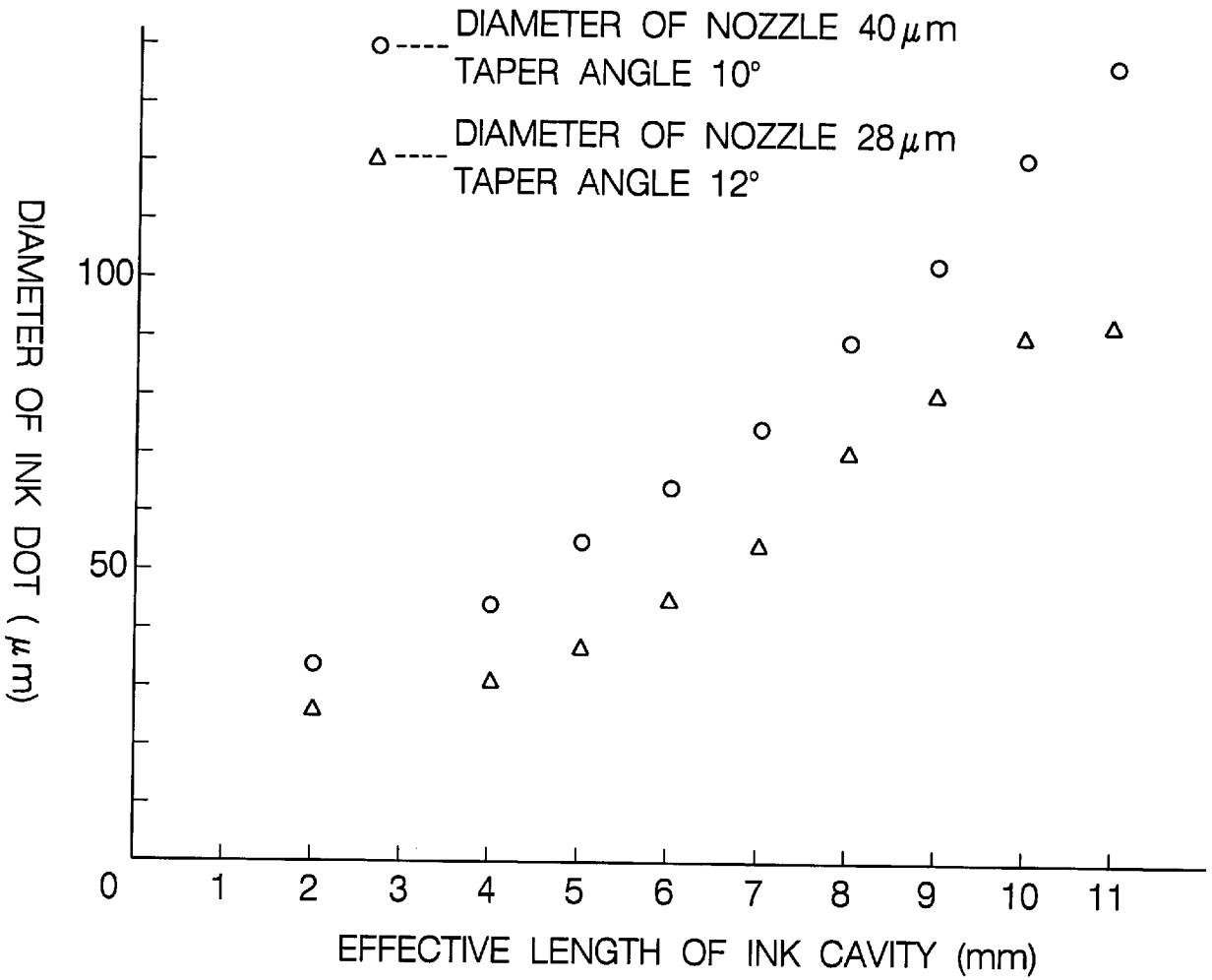
FIG. 8 is a graph showing the relationship between the effective length of ink cavities and the diameter of deposited dots.

FIG. 8 is a graph showing results obtained by investigating variations in the dot diameter while the effective length L was varied while the voltage applied to piezoelectric actuators 15 and 25 was kept constant (30 volts). As apparent from this graph, even if the applied voltage is constant, the diameter of deposited ink dots can be enlarged by increasing the length the ink cavity effective length L. Therefore, by enlarging the difference between the ink cavity effective lengths $L_1$ and $L_2$ of the head portions 10 and 20, an even wider-range variation of dot diameter can be obtained so that the number of gradation levels can be increased further.

Although the ink jet recording head 1 has two head portions 10 and 20 in the previous embodiment, three or more head portions having respective ink cavities of different length may be provided. In this instance, the size of ink droplets can controlled by the controller 9 for the respective head portions, which widening the ranges of variation in the dot diameter and gradation levels.

Also, as shown in FIG. 8, even when the respective ink cavities in the head portions have the same effective length L, it is apparent that the larger the nozzle diameter, the larger the size of ejected ink droplets and the diameter of deposited dots. Therefore, the nozzles 14 and 24 have been formed into the same diameter in the ink jet recording head 1, however, if the nozzle diameter is provided in different sizes for the head portions 10 and 20, the range of variation in the dot diameter can be further widened so that the number of gradation levels can be increased.

Furthermore, the control by the controller 9 on the conditions under which the voltage is applied to piezoelectric actuators 15 and 25 is not limited to variation in the voltage value of pulse voltage. Alternatively, the voltage value constant, the control can be achieved by varying the voltage-applying time, by varying the number of times to which a short pulse voltage is applied, by varying the rise time elapsing before reaching the constant voltage value, or by varying the ink pressurizing energy through a control process in combination of any of these measures. As a result, the range for selection of drivers is broadened, making it possible to realize lower cost.

Although the present invention has been fully described by way of examples and with reference to the accompanying drawings, it is to be noted that various changes and modifications will be apparent to those skill in the art. Therefore, unless otherwise such changes and modifications depart from the scope of the present invention, they should be construed as being included therein.

What is claimed is:

1. An ink-jet recording head having first and second head portions, and a controller, each of said head portions comprising:

a plate having an ink cavity for accommodating an ink material;

a nozzle extending from said ink cavity for ejecting therethrough said ink material accommodated in said ink cavity; and an actuator disposed adjacent to said ink cavity, said actuator causing said ink material to be ejected through said nozzle as an ink droplet;

wherein a size of said ink cavity in said first head portion is different than a size of said ink cavity in said second head portion to thereby eject through said first head portion said ink droplet having a size which is different from a size of said ink droplet ejected through said nozzle in said second head portion, wherein a size of said nozzle in said first head portion is the same as a size of said nozzle in said second head portion; and wherein said controller is adapted to control a voltage applied to each of said actuators in each of said first and second head portions so that in at least one of said head portions the voltage applied to said actuator is controlled so as to change a size of said ink droplet ejected therefrom.

2. An ink-jet recording head in accordance with claim 1, wherein said actuator is a piezoelectric actuator adapted to deform in response to a voltage applied to the piezoelectric actuator.

3. An ink-jet recording head in accordance with claim 1, wherein the controller controls said actuators in each of said first and second head portions to change a size of ink droplets ejected through said nozzles of said first and second head portions respectively.

4. An ink-jet recording head in accordance with claim 1, wherein said actuators are piezoelectric actuators and wherein a size of said piezoelectric actuator in said first head portion is different than a size of said piezoelectric actuator and said second head portion.

5. An ink-jet recording head in accordance with claim 4, wherein a major dimension of said ink cavity in said first head portion and a major dimension of said ink cavity in said second head portion are disposed substantially along a common centerline and wherein said size of said piezoelectric actuator in each of said first and second head portions is a size measured along an extending direction of said common centerline.

6. An ink-jet recording head in accordance with claim 5, wherein a size of said piezoelectric actuator in said first head portion is smaller than a size of said piezoelectric actuator in said second head portion and a size of said ink cavity in said first head portion is smaller than a size of said ink cavity in said second head portion.

7. An ink-jet recording head in accordance with claim 1, wherein said actuators are piezoelectric actuators, further comprising:

a diaphragm disposed between said plate and said piezoelectric actuator, said diaphragm contacting said plate and covering said ink cavity, said piezoelectric actuator contacting said diaphragm on a side opposite to said plate; and a base plate disposed on said piezoelectric actuator on a side opposite said diaphragm;

said piezoelectric actuator deforming in response to a voltage applied thereto wherein said deformation of said piezoelectric actuator in response to said voltage deforms said diaphragm thereby changing a volume of said ink cavity.

8. An ink-jet recording head comprising:

a nozzle plate having first and second concave portions on a second surface thereof and having first and second nozzles extending from a respective one of said first and second concave portions to a first surface of said nozzle plate, said second surface being opposite said first surface;

a diaphragm covering said first and second concave portions to form first and second ink cavities respectively;

first and second actuators disposed on said diaphragm, said first and second actuators positioned opposite said first and second ink cavities, respectively;

a base plate deposited on said first and second actuators on a side opposite said nozzle plate; and a controller to control a voltage applied to said first and second actuators, wherein an actuation of one of said actuators presses on said diaphragm to pressurize an ink material in said corresponding ink cavity and ejects an ink drop through said corresponding nozzle and wherein a size of said first ink cavity is different from the size of said second ink cavity, wherein a size of said first nozzle is substantially the same as a size of said second nozzle, the size of the ink droplet ejected through said first nozzle having a size which is different from a size of the ink droplet ejected through said second nozzle, wherein the voltage applied to at least one of said first and second actuators is controlled so as to change the size of an ink drop ejected from said corresponding ink cavity.

9. An ink-jet recording head in accordance with claim 8, wherein said actuators are piezoelectric actuators and wherein a size of said first piezoelectric actuator is different from a size of said second piezoelectric actuator.

10. An ink-jet recording head in accordance with claim 9, wherein a size of said first piezoelectric actuator is smaller than a size of said second piezoelectric actuator and a size of said first ink cavity is smaller than a size of said second ink cavity.

11. An ink-jet recording head in accordance with claim 9, wherein said controller is adapted for receiving an image signal and outputting a voltage responsive to said image signal to at least one of said first and second piezoelectric actuators;

wherein said controller is adapted to receive an image signal representing any one of a plurality of gradation levels and said controller outputs a variable voltage based on the gradation level of the image signal received.

12. An ink-jet recording head having first and second head portions, and a controller, each of said head portions ejecting an ink material of the same color and comprising:

an ink cavity for accommodating an ink material;

a nozzle extending from said ink cavity for ejecting therethrough said ink material accommodated in said ink cavity; and an actuator disposed adjacent to said ink cavity, said actuator causing said ink material to be ejected through said nozzle as an ink droplet;

wherein a size of said ink cavity in said first head portion is different than a size of said ink cavity in said second head portion, and wherein a size of said nozzle in said first head portion is the same as the size of said nozzle in said second head portion; and said controller being adapted to control a voltage applied to each of said actuators in each of said first and second head portions, wherein in at least one of said head portions, the voltage applied to said actuator is controlled so as to change a size of said ink droplet ejected therefrom.

13. An ink-jet recording head in accordance with claim 12, wherein a size of an ink droplet ejected by the first head portion is different from a size of an ink droplet ejected by the second head portion.

14. An ink-jet recording head in accordance with claim 12, further comprising a controller which controls a voltage to be applied to said actuator to change a size of an ink droplet to be ejected through said nozzle.

15. An ink-jet recording head in accordance with claim 12, wherein the controller controls the voltage to be applied to said actuators in each of said first and second head portions to change a size of ink droplets to be ejected through said nozzle in said first and second portions, respectively.

* * * * *